US008939322B2

(12) United States Patent
Laible

(10) Patent No.: US 8,939,322 B2
(45) **Date of Patent: *Jan. 27, 2015**

(54) WALL MOUNTED DISPENSER

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/651,760

(22) Filed: Oct. 15, 2012

(65) Prior Publication Data

US 2014/0103069 A1 Apr. 17, 2014

Related U.S. Application Data

(63) Continuation-in-part of application No. 13/465,471, filed on May 7, 2012, now Pat. No. 8,550,302.

(51) Int. Cl.
*B67D 7/78* (2010.01)

(52) U.S. Cl.
USPC ..... 222/145.1; 222/181.3

(58) Field of Classification Search
USPC ..... 222/181.3, 335, 145.5, 133, 129.2, 222/145.1, 180, 181.1; 137/888, 892, 895, 137/614.2
See application file for complete search history.

(56) References Cited

U.S. PATENT DOCUMENTS

| | | | | |
|---|---|---|---|---|
| 3,658,216 | A | 4/1972 | Schwartzman | |
| 4,341,239 | A * | 7/1982 | Atkinson | 137/493 |
| 4,492,253 | A * | 1/1985 | Raftis | 137/849 |
| 4,535,818 | A * | 8/1985 | Duncan et al. | 137/846 |
| 5,592,966 | A * | 1/1997 | Gates | 137/513.5 |
| 5,791,525 | A * | 8/1998 | Fan | 222/181.3 |
| 5,915,592 | A * | 6/1999 | Mehus et al. | 222/1 |
| 6,082,593 | A * | 7/2000 | Borcherds | 222/181.3 |
| 6,142,345 | A | 11/2000 | Laible | |
| 6,283,330 | B1 * | 9/2001 | Gillespie et al. | 222/145.7 |
| 6,299,035 | B1 * | 10/2001 | Dalhart | 222/505 |
| 6,439,272 | B1 * | 8/2002 | Wertheim | 141/2 |
| 6,499,872 | B2 * | 12/2002 | Sand | 366/160.1 |
| 6,789,708 | B2 * | 9/2004 | Hansen | 222/505 |
| 6,923,345 | B1 | 8/2005 | Laible | |
| 6,945,432 | B2 | 9/2005 | Laible | |
| 6,945,433 | B2 | 9/2005 | Laible | |
| 6,986,443 | B2 | 1/2006 | Laible | |
| 7,331,488 | B2 * | 2/2008 | Naslund et al. | 222/144 |
| 7,445,028 | B1 * | 11/2008 | Aanonsen et al. | 137/846 |
| 7,832,599 | B2 | 11/2010 | Laible | |
| 8,459,506 | B2 * | 6/2013 | Schiller et al. | 222/145.5 |
| 8,550,302 | B1 * | 10/2013 | Laible | 222/133 |
| 2001/0054448 | A1 * | 12/2001 | McFarland | 137/849 |
| 2004/0050438 | A1 * | 3/2004 | Haas | 137/888 |
| 2004/0065673 | A1 * | 4/2004 | Hansen | 222/1 |
| 2010/0024896 | A1 * | 2/2010 | Dalhart | 137/87.04 |
| 2011/0095047 | A1 * | 4/2011 | Hubmann et al. | 222/1 |

* cited by examiner

*Primary Examiner* — Kevin P Shaver
*Assistant Examiner* — Michael J Melaragno
(74) *Attorney, Agent, or Firm* — Dennis L. Thomte; Thomte Patent Law Office LLC

(57) ABSTRACT

A wall mounted dispenser for dispensing a mixture of water and liquid chemicals which may be used as a separate dispenser or in combination with other like dispensers. The dispenser of this invention includes several backflow preventers to ensure that the water supply will not become contaminated during backflow problems.

10 Claims, 11 Drawing Sheets

WALL MOUNTED DISPENSER

CROSS REFERENCE TO RELATED APPLICATION

This is a Continuation-In-Part application of application Ser. No. 13/465,471 filed May 7, 2012 now U.S. Pat. No. 8,550,302 entitled A WALL MOUNTED DISPENSER.

BACKGROUND OF THE INVENTION

1. Field of the Invention

This invention relates to a wall mounted dispenser for dispensing a water and liquid chemical mixture therefrom and more particularly to wall mounted dispensers which may be fluidly connected together in a side-by-side series manner. Even more particularly this invention relates to a wall mounted dispenser which includes at least four backflow prevention devices therein.

2. Description of the Related Art

Many types of dispensers have been previously provided for dispensing liquid chemicals into a receptacle such as a bottle, bucket, etc. Further, many of the prior art dispensers are able to dispense a water and liquid chemical mixture into a receptacle. However, it is Applicant's belief that the prior art dispensers are not able to be connected in a series manner in a side-by-side manner. Further, it is not believed that the prior art dispensers are fully able to prevent backflow from the dispenser to the source of water which is especially dangerous when the dispenser is used to dispense a water and liquid chemical mixture therefrom.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A wall mounted dispenser is disclosed for dispensing a mixture of water and liquid chemical therefrom. The dispenser of this invention may be used in conjunction with other dispensers so that the dispensers are positioned side-by-side in a series manner. Inasmuch as the dispenser can be used as a separate dispenser or used in conjunction with other dispensers, only a single dispenser will be described in this summary.

The dispenser includes a first horizontally disposed body portion having a first end, a second end, a forward side and a rearward side. A second horizontally disposed body portion extends transversely forwardly from the first body portion. A third vertically disposed body portion extends downwardly from the second body portion. A first elongated water passageway, having inlet and discharge ends, extends through the first body portion. The inlet end of the first water passageway is in fluid communication with a source of water under pressure. A check valve is positioned in the inlet end of the first water passageway. The discharge end of the first water passageway is selectively closable by a cap. The first body portion has a second water passageway formed therein which extends horizontally forwardly from the first water passageway. The first body portion has a forwardly presented valve stop formed therein near the forward end of the second water passageway.

The second body portion has a bore formed therein which extends forwardly from the valve stop. The second body portion also has a water passageway which extends downwardly from the bore thereof.

A cylindrical valve guide is positioned in the bore of the second body portion forwardly of the valve stop with the rearward end of the valve guide being spaced from the valve stop. The valve guide has a first bore formed therein which extends rearwardly into the valve guide from the forward end thereof. The valve guide has a second bore formed therein which extends rearwardly from the rearward end of the first bore thereof. The rearward end of the valve guide has an annular, rearwardly presented valve seat formed therein. The valve guide has a water passageway having upper and lower ends which extends downwardly from the second bore of the valve guide which fluidly communicates with the water passageway which extends downwardly from the second body portion.

A cap, having a central opening formed therein, is mounted on the forward end of the valve guide. An elongated, horizontally disposed, valve stem, having forward and rearward ends, extends rearwardly through the central opening of the cap into the first bore of the valve guide so that the forward end of the valve stem is positioned forwardly of the cap and so that the rearward end of the valve stem is positioned in the rearward end of the bore of the second body portion. The valve stem is selectively movable between a first outer position to a second inner position. An actuator lever is movably secured to the dispenser for moving the valve stem between outer and inner positions. A spring is positioned between the cap and the actuator lever to yieldably maintain the valve stem in its first outer position. The valve stem has an annular valve mounted thereon at the rearward end thereof which seats upon the valve seat to close the valve seat when the valve stem is in its first outer position.

The third body portion has a chamber formed therein which has upper and lower ends. The upper end of the chamber in the third body portion is in fluid communication with the water passageway which extends downwardly from the bore of the second body portion.

A venturi body, having open upper and lower ends, is secured to the third body portion and extends downwardly therefrom. The venturi body has a chamber formed therein which extends downwardly from the open upper end of the venturi body. The open upper end of the venturi body embraces the lower end of the third body portion to attach the venturi body to the third body portion. A poppet valve, having upper and lower ends, is vertically movably mounted in the chamber of the third body portion and the chamber of the venturi body.

The venturi body has an upwardly presented valve seat at the lower end thereof. A discharge conduit extends downwardly from the lower end thereof, the upper end of which is in communication with the valve seat of the venturi body. A chemical intake conduit, having an intake end and a discharge end is also provided. The intake end of the chemical intake conduit is in communication with a source of liquid chemical. The discharge end of the chemical intake conduit is in fluid communication with the discharge conduit to create a venturi at the juncture of the discharge end of the chemical intake conduit and the discharge conduit.

The venturi body has a plurality of backflow prevention openings formed therein above the lower end thereof which communicates with the atmosphere. The backflow prevention openings are closed by the poppet valve when the poppet valve is in its lower position.

The dispenser of this invention not only provides a convenient way of dispensing a chemical and water mixture but also has several backflow preventers which ensure that the water supply will not be contaminated during backflow occurrences.

It is therefore a principal object of the invention to provide an improved dispenser for dispensing a mixture of water and liquid chemicals.

A further object of the invention is to provide a dispenser of the type includes several backflow preventers which ensure that the water source will not become contaminated should backflow problems occur.

A further object of the invention is to provide a dispenser of the type described which may be used separately, or in series combinations with one or more other dispensers.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to the parts throughout the various views unless otherwise specified.

DESCRIPTION OF THE PREFERRED EMBODIMENT

Figure 1:
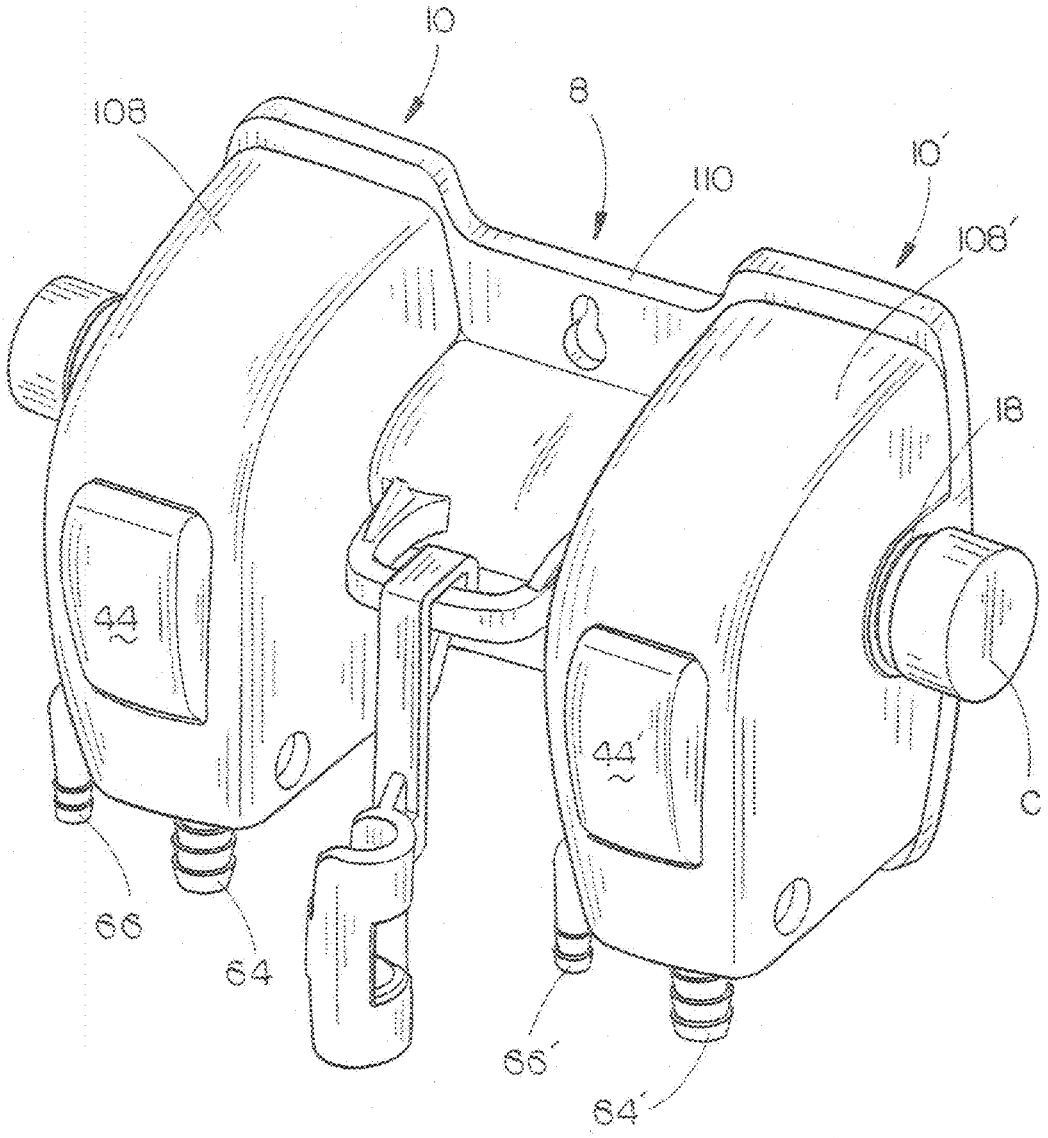
FIG. 1 is a front prospective view of wall mounted dispenser of this invention.
Figure 2:
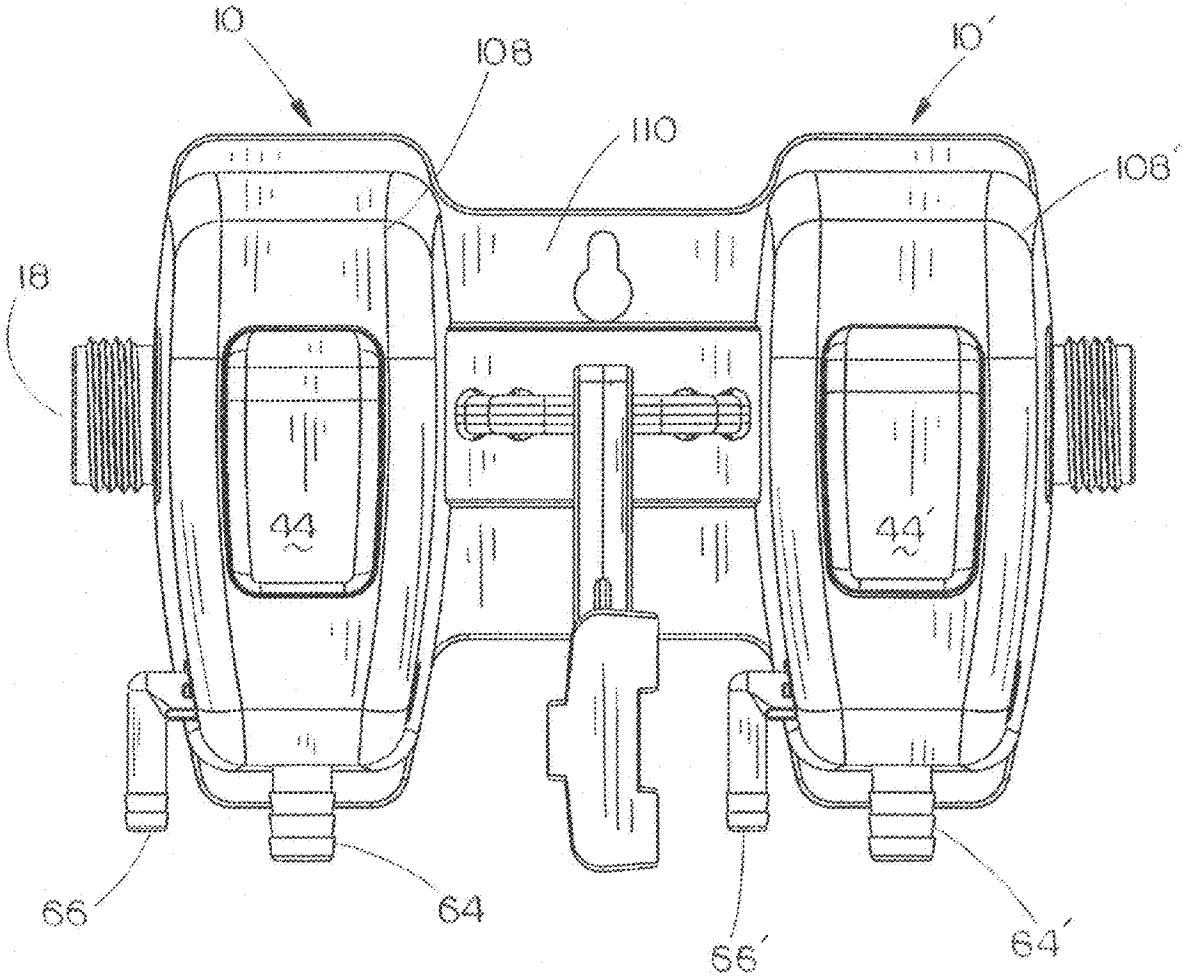
FIG. 2 is a front view of the wall mounted dispenser of this invention.
Figure 3:
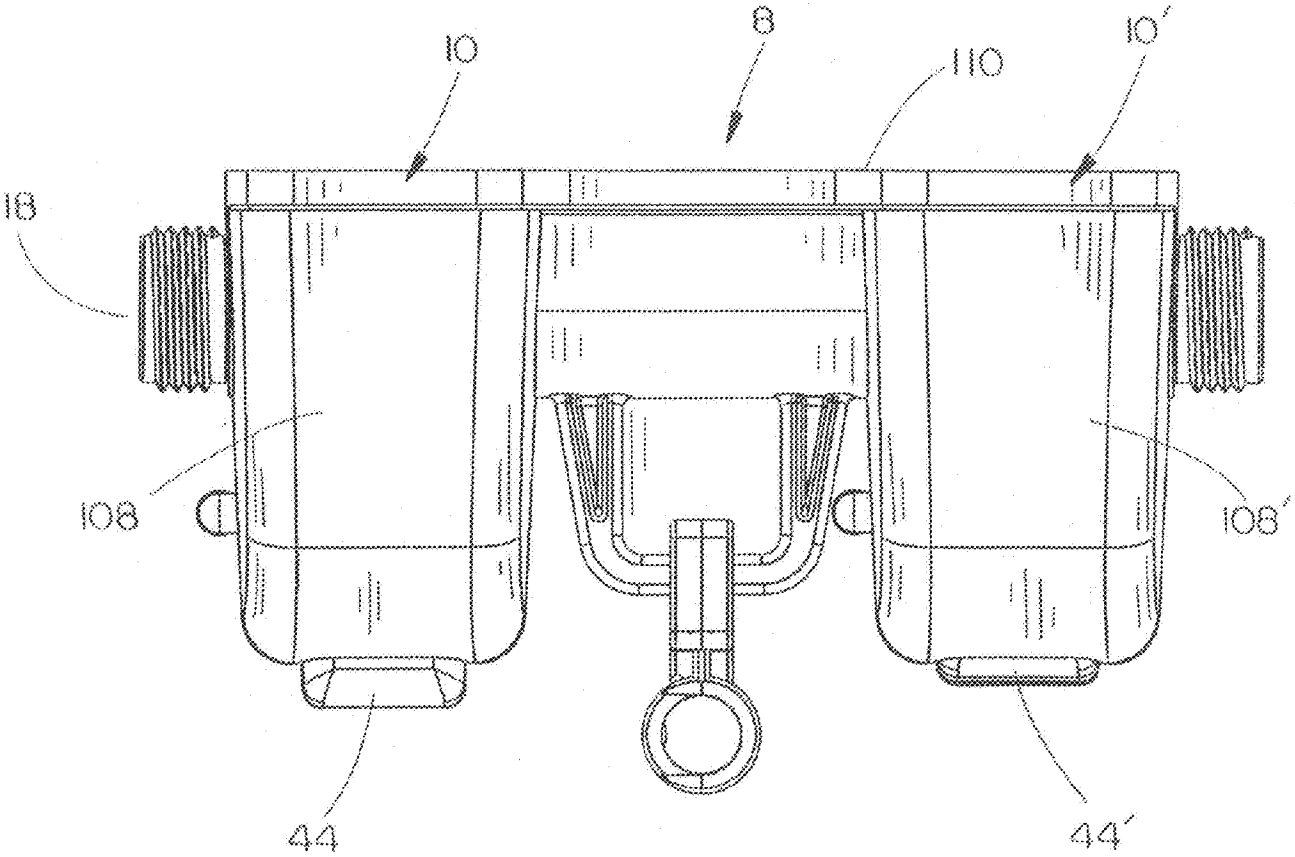
FIG. 3 is a top view of the wall mounted dispenser of this invention.
Figure 4:
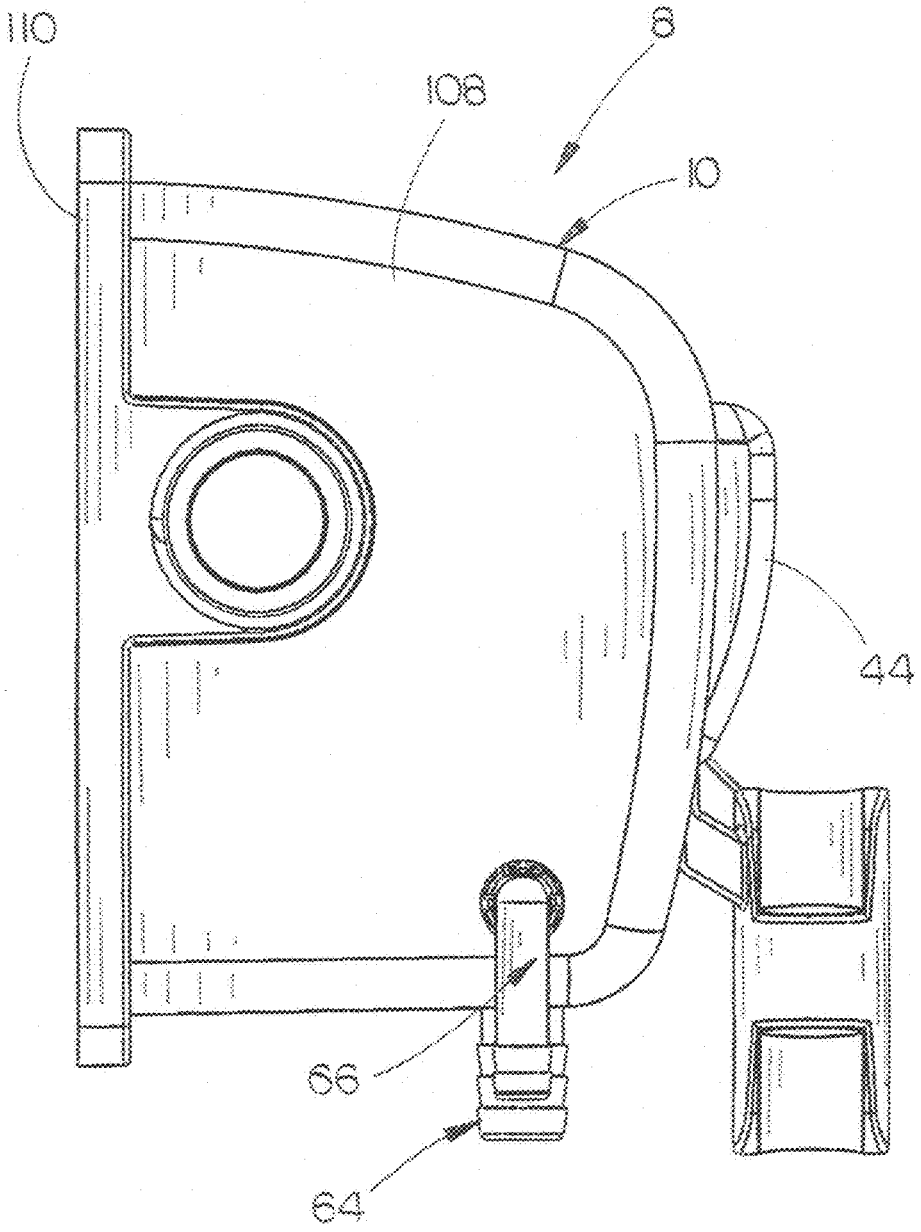
FIG. 4 is a left-end view of the wall mounted dispenser of this invention.
Figure 5:
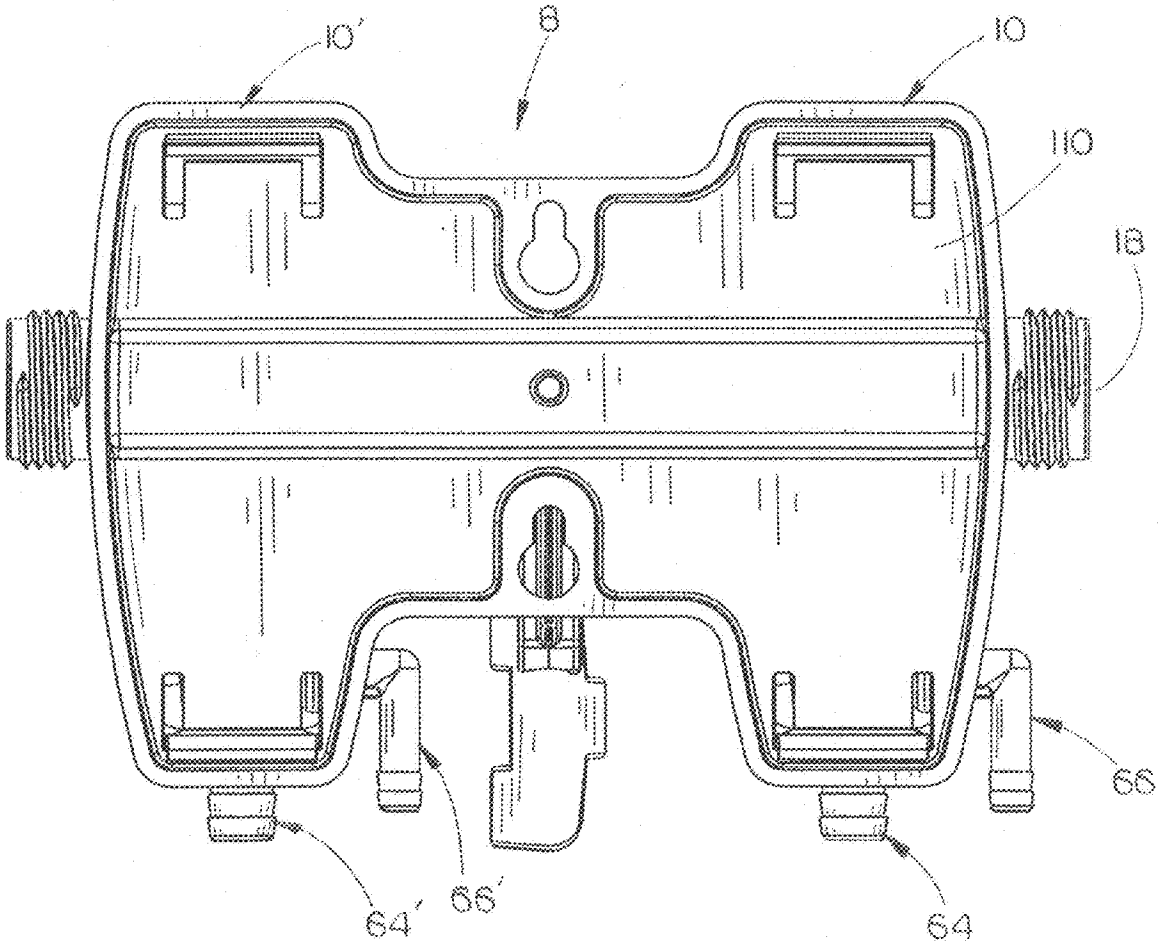
FIG. 5 is a back view of the wall mounted dispenser of this invention.
Figure 6:
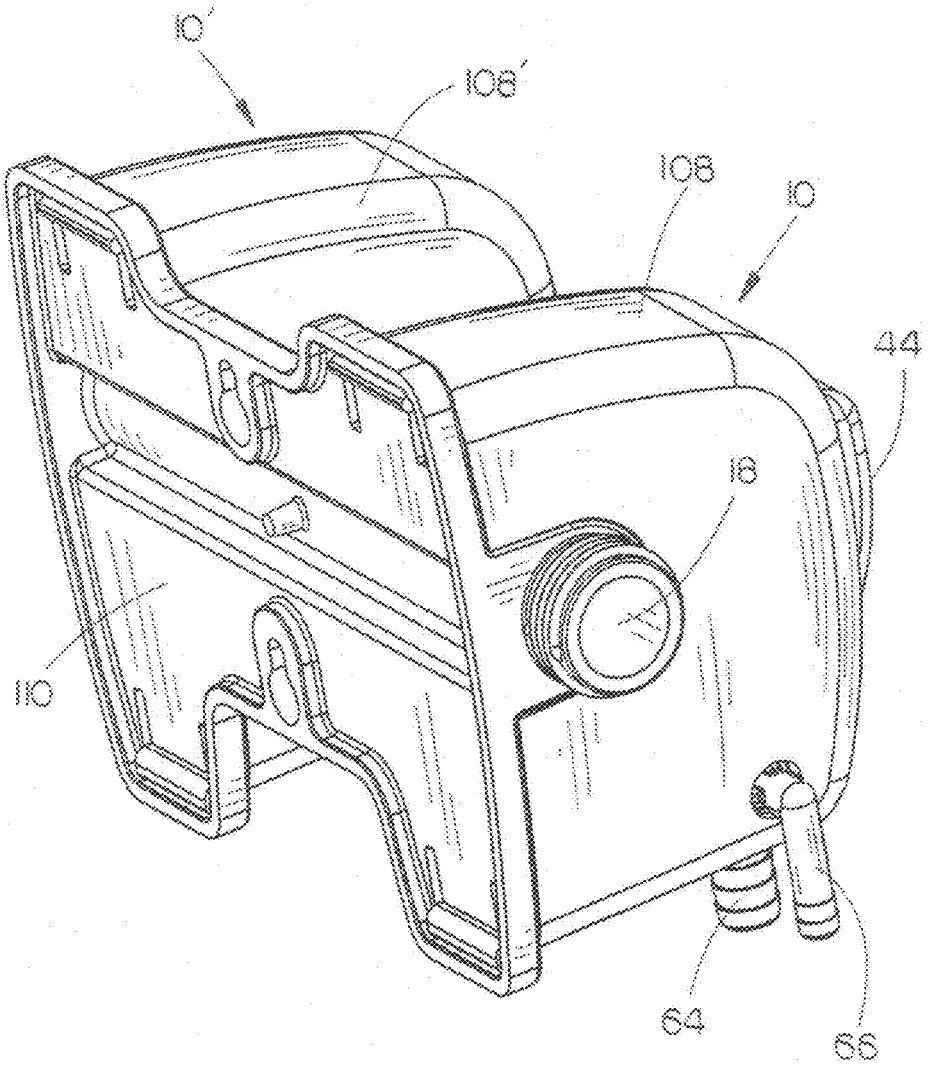
FIG. 6 is a rear prospective view of the wall mounted dispenser of this invention.
Figure 7:
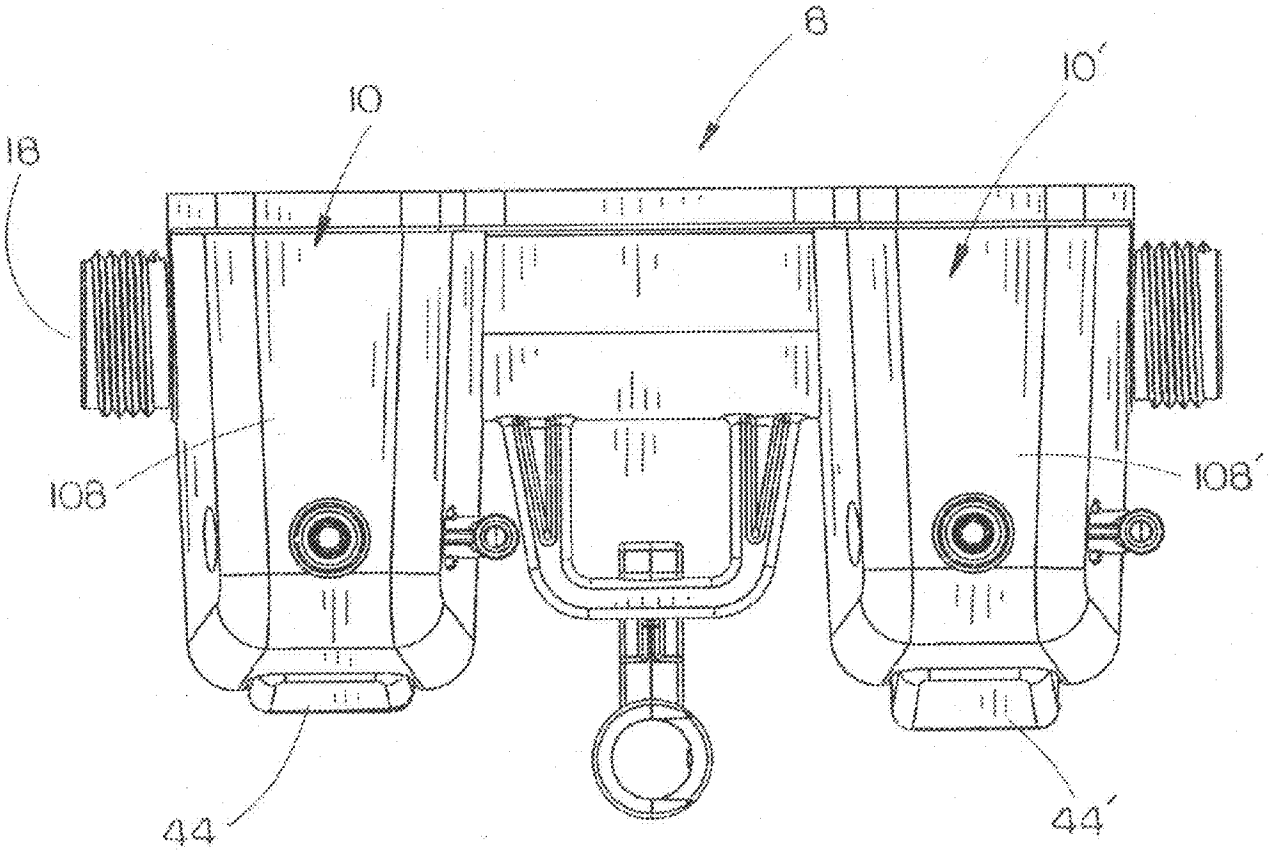
FIG. 7 is a bottom view of the wall mounted dispenser of this invention.
Figure 8:
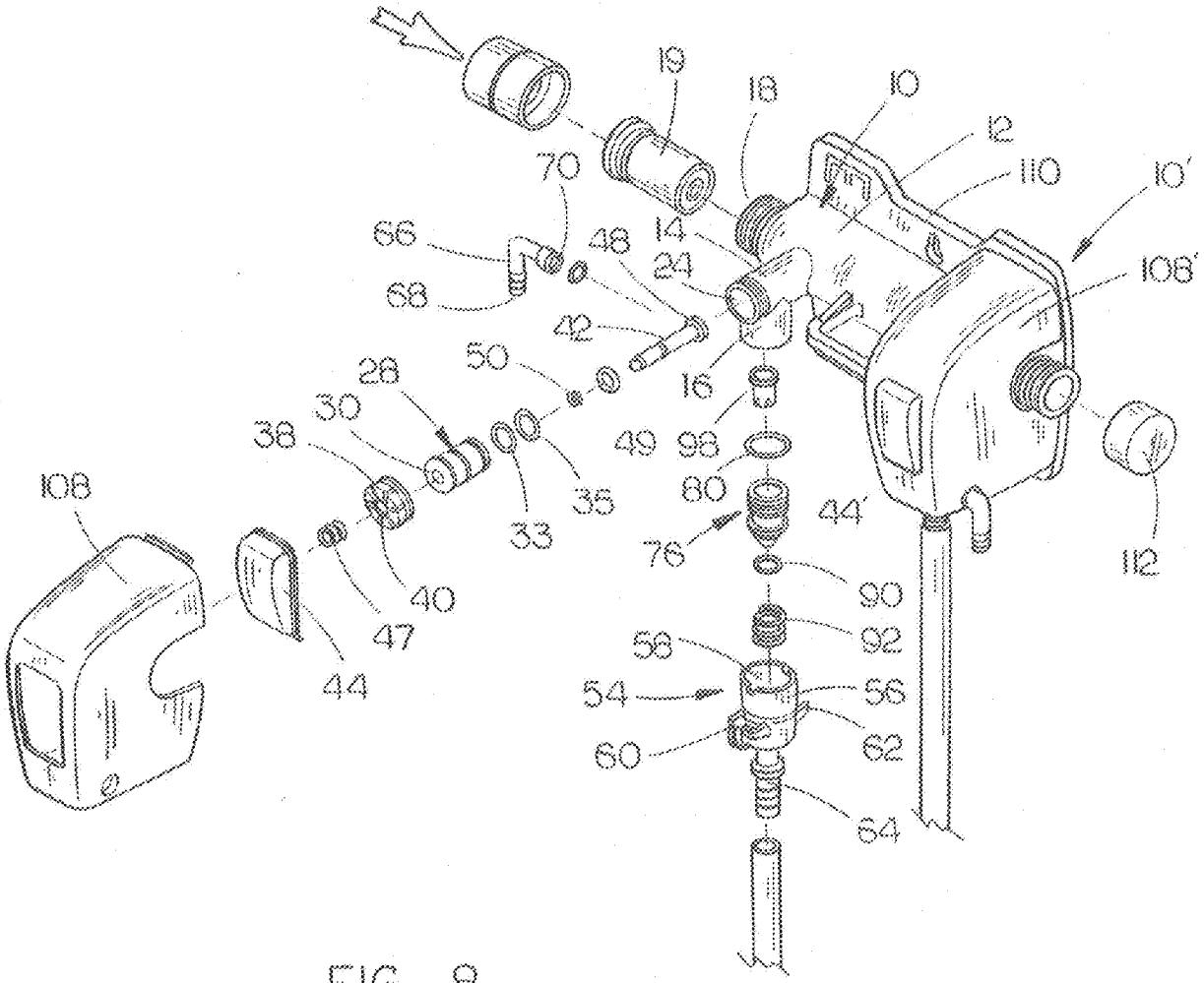
FIG. 8 is a partial exploded perspective view of the wall mounted dispenser of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The wall mounted dispenser assembly of this invention is referred to by the reference numeral 8. The dispenser assembly 8 shown in the drawings includes two dispensers 10 and 10' which are molded together. A single dispenser 10 may be utilized as well as the dual dispenser system which is shown in the drawings. If a separate dispenser 10 is used, any number of those separate dispensers 10 may be coupled together in a side-by-side manner with the inlet end of the first water passageway in the upstream dispenser being connected to a source of water under pressure with the discharge end of the first passageway of the upstream dispenser being fluidly connected to the inlet end of the first water passageway in the downstream dispenser. If only a single dispenser 10 is being used, the discharge end of the dispenser 10 will be closed. In this description, only a single dispenser 10 will be described in detail with "" indicating identical structure on dispenser 10'. The dual dispenser assembly 8 will be described.

The dispenser 10 includes a horizontally disposed first body portion 12, a horizontally extending second body portion 14 which extends transversely forwardly from the first body portion 12 and a vertically disposed body portion 16 which extends downwardly from body portion 14.

A first water passageway 18 extends horizontally through body portion 12 and has an inlet end connected to a source of water under pressure. A check valve 19 is positioned in the inlet end of passageway 18. If only a single dispenser 10 is being used, the discharge end of passageway 18 will be closed by a cap C or the like. If two dispensers 10 are being used, the discharge end or side of the passageway 18 of the upstream dispenser will be fluidly connected to the inlet end of the first passageway of the downstream dispenser 10.

The first body portion 12 has a second water passageway 20 formed therein which extends horizontally forwardly from the first water passageway 18 between the inlet and discharge ends thereof. For purposes of description, the second water passageway 20 will be described as having rearward and forward ends. The first body portion 12 has a forwardly presented valve stop 22 formed therein rearwardly of the forward end of the second water passageway 20.

Figure 9:
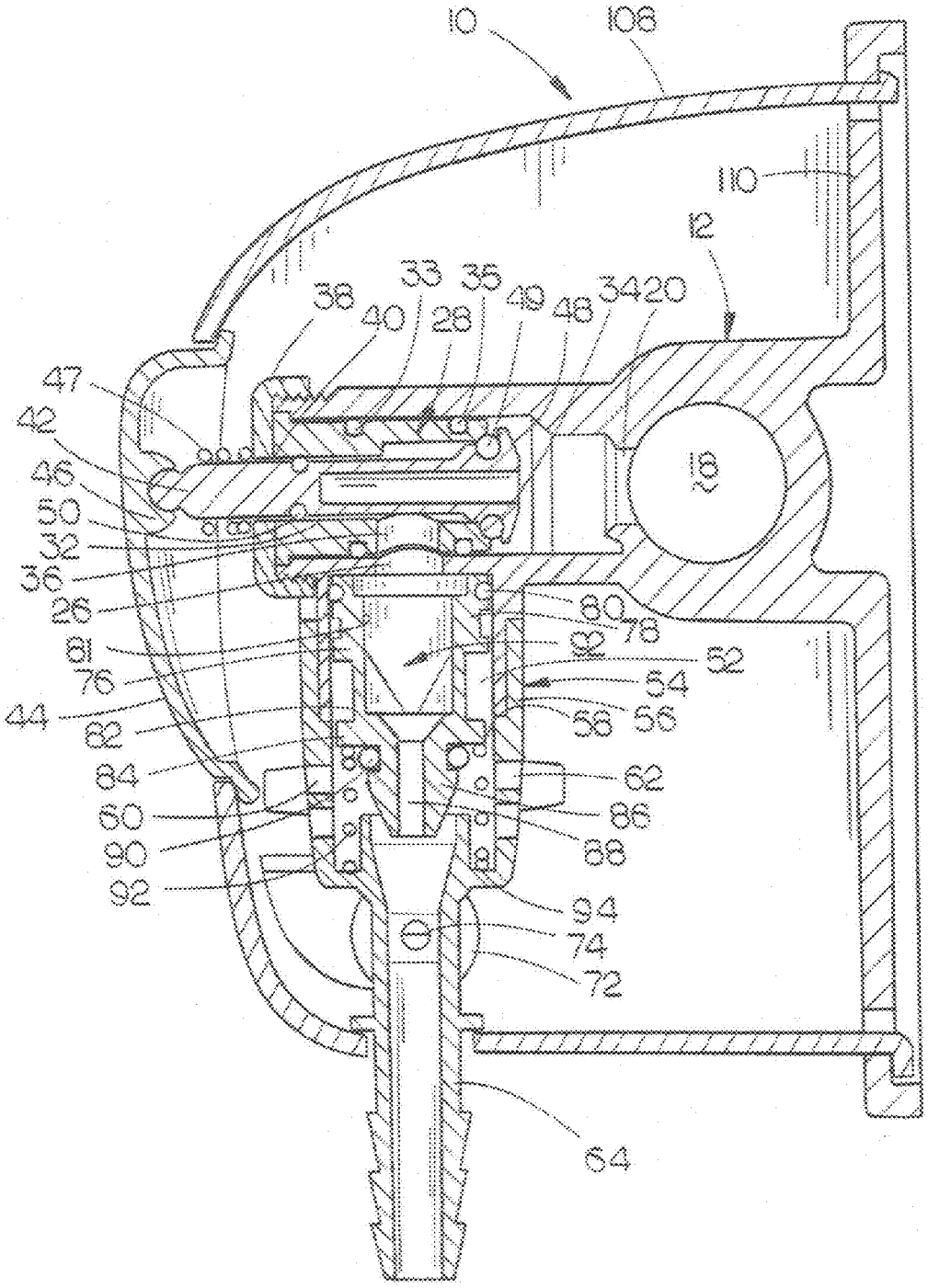
FIG. 9 is a sectional view of the wall mounted dispenser of this invention.

The second body portion 14 has rearward and forward ends and has a bore 24 therein which extends forwardly from the valve stop 22. The second body portion 14 has a water passageway 26 formed therein which extends downwardly from bore 24 as seen in FIG. 9.

A cylindrical valve guide 28, having forward and rearward ends, is positioned in the bore 24 of the body portion 14 forwardly of the valve stop 22 with the rearward end of the valve guide 28 being spaced forwardly from the valve stop 22. The valve guide 28 has a first bore 30, having forward and rearward ends, formed therein which extends rearwardly into the valve guide 28 from the forward end thereof. The valve guide 28 has a second bore 32 formed therein which has forward and rearward ends formed therein and which extends rearwardly from the rearward end of the first bore 30 of the valve guide 28. The second bore 32 of the valve guide 28 has a greater diameter than the first bore 30 of the valve guide 28. The rearward end of the valve guide 28 has a rearwardly presented valve seat 34 formed therein. O-rings 33 and 35 embrace valve guide 28. The valve guide 28 has a water passageway 36 formed therein which extends downwardly from the second bore 32 of the valve guide 28 which fluidly connects with the water passageway 26 in body portion 14. A cap 38, having a central opening 40 formed therein, is mounted on the forward end of the second body portion 14.

The numeral 42 refers to an elongated, horizontally disposed valve stem which has forward and rearward ends. The valve stem 42 extends rearwardly through the central opening 40 of the cap 38 into the first bore 30 of the valve guide 28 so that the forward end of the valve stem 42 is positioned forwardly of cap 38 and so that the rearward end of the valve stem 42 is positioned in the rearward end of bore 24 of body portion 14. The valve stem 42 is selectively movable between a first outer position to a second inner position. The numeral 44 refers to an actuator or operating lever which is pivotally mounted with respect to the valve stem 42 and which has a socket 46 formed at the inner side thereof which engages the head of the first valve stem 42 for moving the valve stern 42 between its outer and inner positions. Spring 47 embraces valve stem 42 between socket 46 of lever 44 and cap 40 to yieldably urge valve stem 42 to its outer position as seen in FIG. 9.

The valve stem 42 has an annular valve 48, including an O-ring 49, mounted thereon at the rearward end thereof which seats upon the valve seat 84 when the valve stem 42 is in its outer position.

As seen in FIG. 9, O-ring 50 embraces the valve stem 42. The numeral 54 refers to a venturi body. Venturi body 54 includes a cylindrical body portion 56 which is secured to the lower end of body portion 16 (FIG. 9). Body portion 56 defines a chamber 58 therein. Body portion 56 has air gap openings 60 and 62 formed therein which communicate with chamber 58 and with the atmosphere. The numeral 64 refers to a vertically disposed discharge conduit or tube which extends downwardly from the body portion 56 and which has open upper and lower ends. The open upper end of the discharge conduit 64 is in fluid communication with chamber 58.

The numeral 66 refers to a liquid chemical conduit or tube having an intake end 68 and a discharge end 70. The inlet end 68 is in fluid communication with a container having liquid chemical therein. The discharge end 70 of conduit 64 is in fluid communication with the outer end of the hollow fitting 72 which extends from conduit 64 and which is in fluid communication with the interior of conduit 64. A venturi 74 is created at the juncture of conduit 72 and 64.

The numeral 76 refers to a poppet valve which is vertically movable in chamber 58 of venturi body 54. Poppet valve 76 includes a cylindrical body portion 78 at its upper end which has an O-ring 80 embracing the outer surface thereof. O-ring 80 slidably engages the inner wall surface of body portion 56. Poppet valve 76 includes a chamber 81. Poppet valve 76 also includes an annular recess 82 formed therein above the annular shoulder 84. Poppet valve 76 further includes a tapered valve 86 at the lower end thereof. The valve 86 has a passageway or bore 88 extending upwardly therethrough which communicates with the lower end of chamber 81. An O-ring 90 embraces the upper end of valve 86. The numeral 92 refers to a spring which is mounted in chamber 58. The upper end of spring 92 engages the underside of shoulder 84 with the lower end of spring 90 engaging venturi body 54 at 94.

Figure 10:
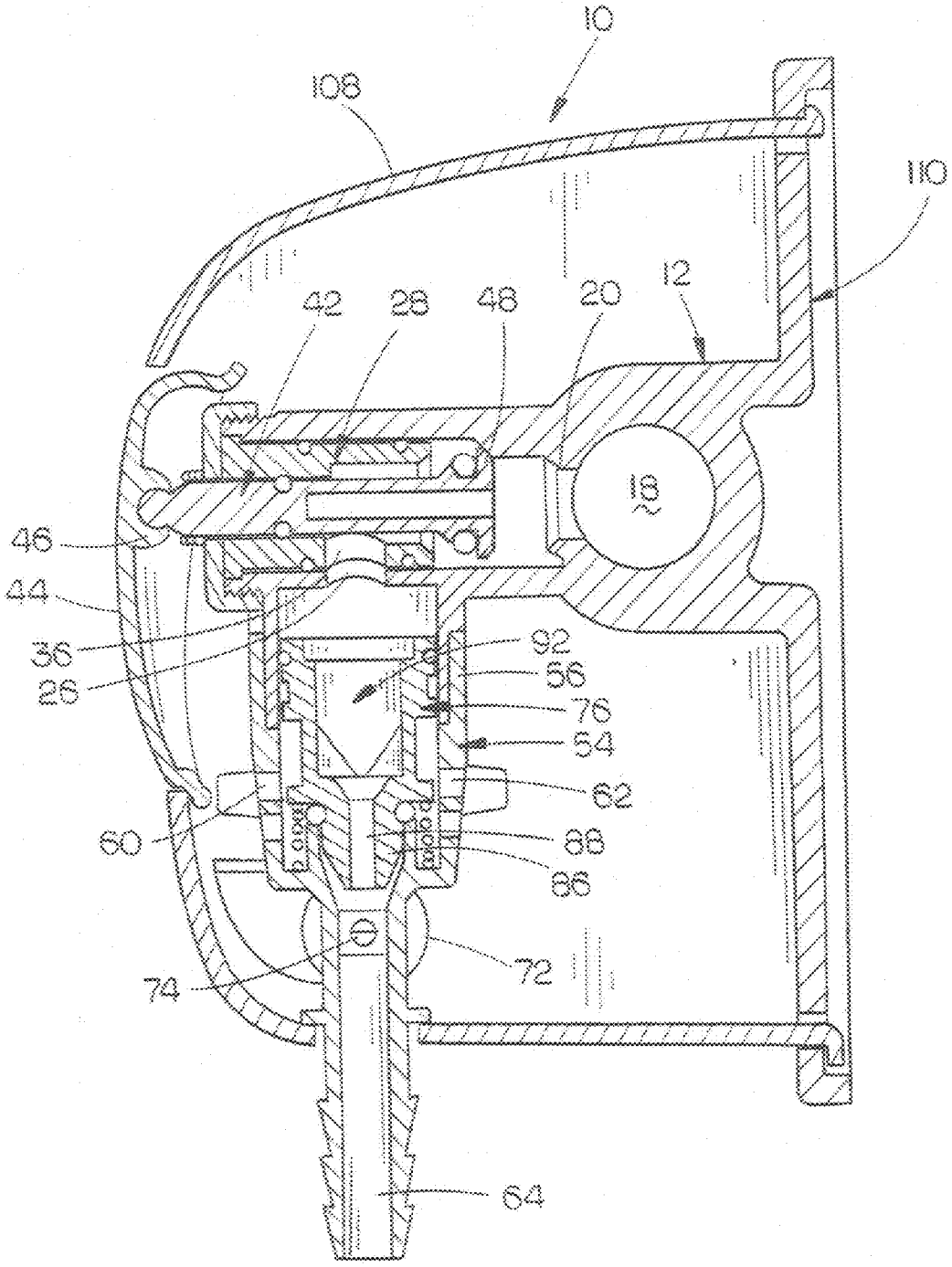
FIG. 10 is a sectional view of the wall mounted dispenser of this invention in a chemical dispensing position.
Figure 11:
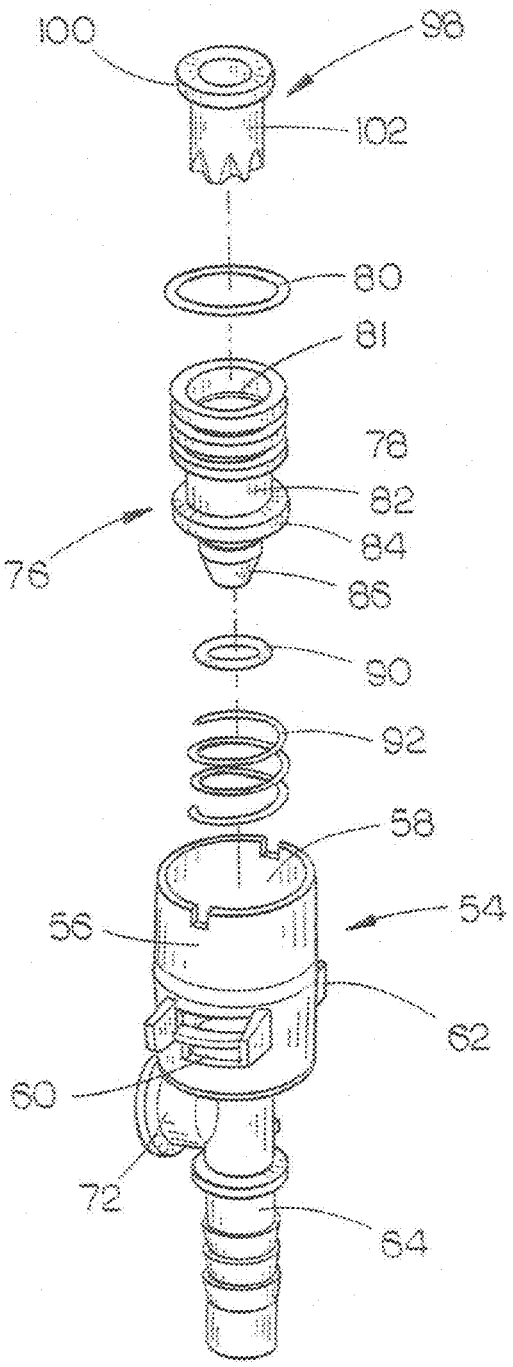
FIG. 11 is an exploded perspective view of the venturi body portion of the invention.
Figure 12:
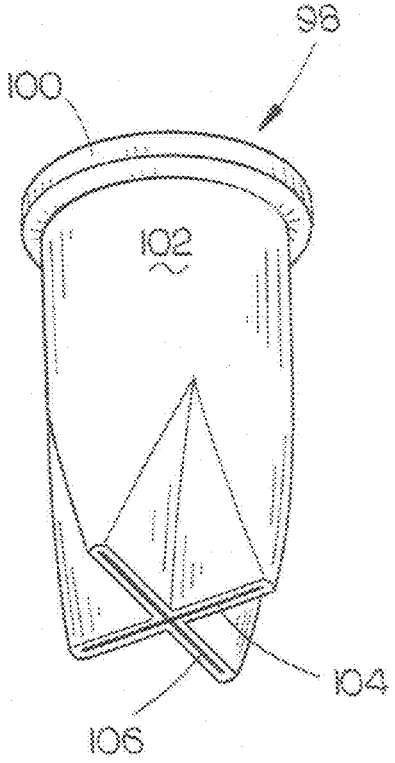
FIG. 12 is a perspective view of the duck-bill check valve which is positioned in the venturi body of this invention.

When poppet valve 76 is in its lower position of FIG. 10, valve 86 seats upon the open upper end of conduit 64 to close the open upper end of conduit 64. The numeral 98 refers to a flexible duck-bill check valve. Check valve 98 has a flange 100 at its upper end as seen in FIG. 12. Check valve 98 includes a hollow tubular portion 102 which extends downwardly from flange 100. The lower end of tubular portion 102 has a pair of intersecting normally closed slits 104 and 106. When water is introduced downwardly into the interior of check valve 98, the slits 104 and 106 open to permit the water to pass downwardly therethrough. If water or other liquid moves upwardly into engagement with the normally closed lower end of check valve 98, the slits 104 and 106 remain closed to prevent the water or other liquid from passing upwardly through the check valve. Check valve 98 is positioned in chamber 81 of poppet valve 76 with the underside of flange 100 engaging the shoulder 108 formed in the upper end of poppet valve as seen in FIG. 9. As seen in FIG. 9, the lower end of check valve 98 is positioned at the upper end of bore 88.

The numerals 108 and 108' refer to shrouds which extend around the dispensers 10 and 10' respectively. The assembly includes a backing plate 110 which may be secured to a wall or the like.

Assuming that only a single dispenser is being used, the operation of the same is as follows. The inlet end of the first passageway is connected to a source of water under pressure by a hose or the like. The discharge end of the water passageway 18 is closed with the cap C. The liquid chemical conduit 66 is connected to a container having liquid chemical therein. A container such as a jug, bucket, etc. is placed beneath the discharge tube 114, which is connected to the discharge conduit 64.

At that time, the backflow of chemical into the water hose and water source is prevented by the check valve 19. Backflow is also prevented by the valve 48 and O-ring 49 being in seating engagement with the valve seat 34 due to the spring force of the spring 47 which urges the valve stem 42 towards its outer position.

Backflow is also prevented by the duck-bill valve 98 which prevents upward flow of chemical therethrough. Backflow is further prevented due to the poppet valve 76 being urged to its upper position (FIG. 9) by the spring 92. When the poppet valve 76 is in its upper position, the backflow prevention openings 60 and 62 are in communication with the atmosphere. If chemical is somehow sucked into the chamber 58, that chemical will be discharged therefrom through the openings 60 and 62 into the area around the dispenser 10 and not into the water source. If one of the backflow prevention devices or apparatuses should fail, the other three devices or apparatuses will prevent the water source from being contaminated. Even if three of the backflow prevention devices or apparatuses should fail, the fourth device or apparatus will prevent the water source from being contaminated.

When it is desired to dispense a mixture of water and liquid chemicals, the lever 44 is pushed inwardly which causes the valve stem 42 to move from the position of FIG. 9 to the position of FIG. 10. The inward movement of valve stem 42 unseats the valve 48 from the valve seat 34 thereby permitting water to pass through the second passageway 20, the bore 24, downwardly through the first bore 30 and into the water passageway 26 in body portion 14. The water pressure in bore 30 will be greater than the spring strength of spring 92 so that the water pressure will move the poppet valve 76 from an upper position (FIG. 9) to a lower position (FIG. 10). In the lower position of FIG. 10, the valve 86 closes the open upper end of conduit 64 so that liquid chemical cannot escape through the openings 60 and 62. The water coming into the upper end of chamber 58 will pass downwardly through the duck-bill valve 98. The water pressure within the valve 98 opens the slits 104 and 106 so that the water passes through the now open lower end of valve 92 into the bore 88 past the venturi 74 which causes liquid chemical to be drawn (sucked) from the chemical container for mixture with the water passing the venturi 74. The liquid chemical/water mixture passes downwardly through the conduit 64 into the bottle, jug, bucket, etc. therebelow.

When the selected amount of water and liquid chemical has been dispensed from the dispenser 10, the inward pressure on the lever 44 will be released which will cause the valve stem 42 to move from its inner position to its outer position so that valve 48 again closes the valve seat to prevent further water from being passed through the dispenser.

If a backflow problem is encountered during the dispensing operation, the check valve 19 will close, the check valve 98 will close and the poppet valve 76 will move upwardly so that any liquid chemical within the lower part of chamber 58 will drain outwardly through the openings 60 and 62 thereby preventing the contamination of the water source. The closing of the open upper end of conduit 64 during the dispensing phase also prevents liquid chemical from by-passing the check valve 98.

Thus it can be seen that a novel dispenser has been provided which has a plurality of backflow preventers provided therein. It can therefore be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A wall mounted dispenser for dispensing a mixture of water and liquid chemical therefrom, comprising:

a first horizontally disposed body portion having a first end, a second end, a forward side and a rearward side;

a second horizontally disposed body portion having a rearward end and a forward end;

said second body portion extending transversely forwardly from said first body portion;

a third vertically disposed body portion, having an open upper end and an open lower end, extending downwardly from said second body portion;

a first elongated water passageway, having first and second ends, extending through said first body portion between said first and second ends thereof;

said first end of said first water passageway being in fluid communication with a source of water under pressure;

said second end of said first water passageway being closable;

said first body portion having a second water passageway formed therein which extends horizontally forwardly from said first water passageway between said first and second ends thereof;

said second water passageway having rearward and forward ends;

said second body portion having a forwardly presented valve stop formed therein at said forward end of said second water passageway;

said second body portion having a bore, having rearward and forward ends, formed therein which extends forwardly from said valve stop;

said second body portion having a water passageway which extends downwardly from said bore thereof;

a cylindrical valve guide, having forward and rearward ends, positioned in said bore of said second body portion forwardly of said valve stop with said rearward end of said valve guide being spaced forwardly of said valve stop;

said valve guide having a first bore, having forward and rearward ends, extending rearwardly into said valve guide from said forward end thereof;

said valve guide having a second bore, having forward and rearward ends, formed therein which extends rearwardly from said rearward end of said first bore thereof;

said second bore of said valve guide having a greater diameter than said first bore of said valve guide;

said rearward end of said valve guide having an annular, rearwardly presented valve seat formed therein;

said valve guide having a water passageway, having upper and lower ends, which extends downwardly from said second bore of said valve guide which fluidly communicates with said water passageway which extends downwardly from said second body portion;

a cap, having a central opening formed therein, mounted on said forward end of said valve guide;

an elongated, horizontally disposed valve stem having forward and rearward ends;

said valve stem extending rearwardly through said central opening of said cap and into said first bore of said valve guide so that said forward end of said valve stem is positioned forwardly of said cap and so that said rearward end of said valve stem is positioned in said rearward end of said bore of said second body portion;

said valve stem being selectively movable between a first outer position and a second inner position;

an actuator lever movably secured to the dispenser for moving said valve stem between said outer and inner positions;

said valve stem having a valve mounted thereon which seats upon said valve seat to close said valve seat when said valve stem is in said first outer position;

said third body portion having a chamber formed therein which has upper and lower ends;

said upper end of said chamber of said third body portion being in fluid communication with said water passageway which extends downwardly from said bore of said second body portion;

a venturi body having upper and lower ends;

said upper end of said venturi body being secured to said third body portion;

said venturi body having a chamber formed therein which extends downwardly thereinto from said upper end thereof;

said venturi body having at least one backflow prevention opening formed therein which extends into said chamber of said venturi body to vent said chamber of said venturi body to the atmosphere;

said venturi body having a discharge conduit, having upper and lower ends, extending downwardly from said lower end thereof;

said upper end of said discharge conduit forming an annular valve seat;

said open upper end of said discharge conduit being in fluid communication with said chamber in said third body portion;

a liquid chemical conduit having an intake end and a discharge end;

said inlet end of said liquid chemical conduit being in fluid communication with a source of liquid chemical;

said discharge end of said liquid chemical conduit being in fluid communication with said discharge conduit so as to create a venturi;

a poppet valve having upper and lower ends;

said poppet valve being movably mounted in said chamber of said venturi body between upper and lower positions;

said poppet valve having a valve at said lower end thereof which engages said valve seat at said upper end of said discharge conduit when said poppet valve is in said lower position;

said poppet valve having a chamber formed therein which extends downwardly into said poppet valve from said upper end thereof;

said poppet valve having a water passageway formed therein which extends upwardly through said valve of said poppet valve into said chamber of said poppet valve;

a normally closed check valve having upper and lower ends;

said check valve being positioned in said chamber of said poppet valve which permits water to pass downwardly therethrough but which prevents chemical or a water/chemical mixture from passing upwardly therethrough;

said backflow prevention opening being closed by said poppet valve when said poppet valve is in its said lower position.

2. The dispenser of claim 1 wherein a check valve is positioned in said first end of said first water passageway.

3. The dispenser of claim 1 wherein a spring is positioned between said actuator lever and said cap which yieldably maintains said valve stem in said outer position.

4. The dispenser of claim 1 wherein said check valve in said chamber of said poppet valve is a duck-bill valve.

5. The wall mounted dispenser of claim 1 wherein a pair of dispensers are mounted together in a side-by-side manner with the second end of the first water passageway of the upstream dispenser is in fluid communication with the inlet end of the first water passageway of a downstream dispenser.

6. The wall mounted dispenser of claim 5 wherein the dispensers are molded together.

7. The wall mounted dispenser of claim 1 wherein a plurality of dispensers are mounted in a side-by-side series manner.

8. A wall mounted dispenser for dispensing a mixture of water and liquid chemical therefrom, comprising:

a first horizontally disposed body portion having a first end, a second end, a forward side and a rearward side;

a second horizontally disposed body portion having a rearward end and a forward end;

said second body portion extending transversely forwardly from said first body portion;

a third vertically disposed body portion, having an open upper end and an open lower end, extending downwardly from said second body portion;

a first elongated water passageway extending into said first body portion from said first end thereof;

said first water passageway being in fluid communication with a source of water under pressure;

said first body portion having a second water passageway formed therein which extends horizontally forwardly from said first water passageway;

said second body portion having a forwardly presented valve stop formed therein at said forward end of said second water passageway;

said second body portion having a bore, having rearward and forward ends, formed therein which extends forwardly from said second passageway in said first body portion;

said second body portion having a water passageway which extends downwardly from said bore thereof;

a cylindrical valve guide, having forward and rearward ends, positioned in said forward end of said bore of said second body portion;

said valve guide having a first bore, having forward and rearward ends, extending rearwardly into said valve guide from said forward end thereof;

said valve guide having a second bore, having forward and rearward ends, formed therein which extends rearwardly from said rearward end of said first bore thereof;

said second bore of said valve guide having a greater diameter than said first bore of said valve guide;

said rearward end of said valve guide having an annular, rearwardly presented valve seat formed therein;

said valve guide having a water passageway, having upper and lower ends, which extends downwardly from said second bore of said valve guide which fluidly communicates with said water passageway which extends downwardly from said second body portion;

a cap, having a central opening formed therein, mounted on said forward end of said valve guide;

an elongated, horizontally disposed valve stem having forward and rearward ends;

said valve stem extending rearwardly through said central opening of said cap and into said first bore of said valve guide so that said forward end of said valve stem is positioned forwardly of said cap and so that said rearward end of said valve stem is positioned in said rearward end of said bore of said second body portion;

said valve stem being selectively movable between a first outer position and a second inner position;

an actuator lever movably secured to the dispenser for moving said valve stem between said first outer and said second inner positions;

said valve stem having a valve mounted thereon which seats upon said valve seat to close said valve seat when said valve stem is in said first outer position;

said third body portion having a chamber formed therein which has upper and lower ends;

said upper end of said chamber of said third body portion being in fluid communication with said water passageway which extends downwardly from said bore of said second body portion;

a venturi body having upper and lower ends;

said upper end of said venturi body being secured to said third body portion;

said venturi body having a chamber formed therein which extends downwardly thereinto from said upper end thereof;

said venturi body having a discharge conduit with upper and lower ends extending downwardly from said lower end thereof;

said upper end of said discharge conduit forming an annular valve seat;

said upper end of said discharge conduit being in fluid communication with said chamber in said third body portion;

a liquid chemical conduit having an intake end and a discharge end;

said inlet end of said liquid chemical conduit being in fluid communication with a source of liquid chemical;

said discharge end of said liquid chemical conduit being in fluid communication with said discharge conduit so as to create a venturi;

a poppet valve having upper and lower ends;

said poppet valve being movably mounted in said chamber of said venturi body between upper and lower positions;

said poppet valve having a valve at said lower end thereof which engages said valve seat at said upper end of said discharge conduit when said poppet valve is in said lower position;

said poppet valve having a chamber formed therein which extends downwardly into said poppet valve from said upper end thereof;

said poppet valve having a water passageway formed therein which extends upwardly through said valve of said poppet valve into said chamber of said poppet valve;

a normally closed check valve having upper and lower ends;

said check valve being positioned in said chamber of said poppet valve which permits water to pass downwardly therethrough but prevents chemical or a water/chemical mixture from passing upwardly therethrough;

said venturi body portion having at least one backflow prevention opening formed therein above said lower end thereof which communicates with the atmosphere;

said backflow prevention opening being closing by said poppet valve when said poppet valve is in its said lower position.

9. The dispenser of claim 8 wherein a backflow check valve is positioned in said first water passageway.

10. The dispenser of claim 8 wherein said check valve in said poppet valve is a duck-bill valve.

* * * * *